United States Patent [19]

Gaiotto et al.

[11] Patent Number: 4,726,528

[45] Date of Patent: Feb. 23, 1988

[54] PRESSURE EQUALIZER FOR USE IN FEEDERS OF CERAMIC ENAMELS OR PAINTS FOR SPRAY GUNS, PARTICULARLY AUTOMATIC SPRAY GUNS INSTALLED ON ENAMELLING OR PAINTING ROBOTS

[75] Inventors: Cesare Gaiotto, Vaiano Cremasco; Alvise Gaiotto, Monte Cremasco, both of Italy

[73] Assignee: Gaiotto Impianti S.p.A., Cremona, Italy

[21] Appl. No.: 923,636

[22] Filed: Oct. 27, 1986

[30] Foreign Application Priority Data

Nov. 8, 1985 [IT] Italy ..... 22757 A/85

[51] Int. Cl.[4] ..... B05B 1/30; F04B 49/00

[52] U.S. Cl. ..... 239/579; 239/587; 417/46

[58] Field of Search ..... 417/46, 395; 901/43; 239/579, 587

[56] References Cited

U.S. PATENT DOCUMENTS

| | | | |
|---|---|---|---|
| 2,699,120 | 1/1985 | Schweisthal | 417/46 |
| 2,765,804 | 10/1956 | Dinkelkamp | 137/102 |
| 3,429,274 | 2/1969 | Nilsson | 417/395 |
| 3,749,527 | 7/1973 | Slagle | 417/395 |
| 3,816,025 | 6/1974 | O'Neill | 417/46 |
| 4,532,148 | 7/1985 | Vecello | 901/43 |
| 4,544,328 | 10/1985 | Credle | 417/46 |
| 4,613,082 | 9/1986 | Gimple | 901/43 |

*Primary Examiner*—William L. Freeh

*Attorney, Agent, or Firm*—Wenderoth, Lind & Ponack

[57] ABSTRACT

This invention relates to a pressure equalizer for use in a feeder designed to feed ceramic enamel, or paint in general, to a spray gun of an automatic type in general, and in particular to a spray gun associated with an enamelling or painting robot. The feeder is of the type utilizing an air-operated pump and the pressure equalizer is mounted close to the spray gun. The pressure equalizer includes a pressure sensing element for sensing the pressure at which enamel or paint is fed to a spray gun, the sensing element applying the pressure changes to a throttling member which is fitted in the line supplying compressed air to the air-operated pump so as to ensure that a controlled constant flow of enamel or paint is fed to the associated spray gun for any working position thereof.

9 Claims, 4 Drawing Figures

PRESSURE EQUALIZER FOR USE IN FEEDERS OF CERAMIC ENAMELS OR PAINTS FOR SPRAY GUNS, PARTICULARLY AUTOMATIC SPRAY GUNS INSTALLED ON ENAMELLING OR PAINTING ROBOTS

BACKGROUND OF THE INVENTION

1. Field of the invention

This invention relates to enamelling or painting plants in general and more specifically to plants of these type utilizing robot systems.

2. Description of the Prior Art

Generally, these plants are intended for enamelling or painting sanitary fittings, household electrical apparatuses and appliances, for example washing machines, refrigerators and so on. For namelling or painting such articles, present spray guns of an automatic type, are used in which the ceramic enamel or the paint to be handles is continuously fed to the spray gun through a feeder. In robotized installations the spray gun is mounted on an articulated wrist of a robot intended to perform all of the required and programmed working movements for a particular article to be enamelled or painted.

Present-day enamelling and painting plants comprise a feeder equipped with a diaphragm pump operated by compressed air. This diaphragm pump supplies enamel or paint from the feeder to the spray gun from which the enamel or paint is expelled outwardly by a jet of compressed air. Obviously, if robots are used to carry out the enamelling or painting operation, the spray gun is mounted on the wrist an arm of the robot which then performs all of the working movements programmed for the specific article to be enamelled or painted.

When very tall articles are to be enamelled or painted, the spray gun has to perform vertical movements of considerable extent with the spray gun operating at various working levels and thus at different working pressures. Since enamelling and painting operations generally utilize low pressures, of the order of about 0.5 atm. for reasons dictated by the enamel or paint characteristics, said difference in the working level or elevation will negatively affect the delivery flow rate of a spray gun because, with the pump delivery being constant, the pump will feed smaller amounts of enamel or paint at the highest levels than at the lowest levels, which results in an article being enamelled or painted in an uneven manner. By way of example, when bath tubs are to be enamelled which are about 2 m high, the spray gun has to perform a vertical movement of more than 2 m in order to enamel the border of the bath tub consequently, a pressure differential of more than 0.2 atm would exist between the lowest position and the highest position of the spray gun, which difference for an overall working pressure of 0.5 atm, is such as to undesirably affect the operation of the spray gun to a significant extent.

SUMMARY OF THE INVENTION

This invention aims at obviating the above mentioned drawback of the known spray guns, by providing a device which enables to regulate the pressure at which a feeder is feeding enamel or paint to a spray gun as a function of the height at which that spray gun is operating at the time.

More specifically, the present invention provides a pressure equalizer for use in an air-pump feeder intended to feed ceramic enamel or paint in general to an automatic type of spray gun, that is characterized in that it includes a pressure sensor connected with the enamel or paint supplying line and a variable throttling member fitted in the line supplying the compressed air to the pneumatic pump, said throttling member being interconnected to the pressure sensor so as to cause the feeder air-pump to supply at any time a constant flow to the spray gun for any position thereof, said pressure equalizer being mounted on either the spray gun or an element arranged thereat.

In this way, the pressure equalizer is at any time at the same level as is the spray gun, so as to follow the spray gun in its movements and thus to control the flow of enamel or paint to it, through the pressure sensor which also operates at the same level.

According to one aspect of this invention, the pressure sensor is a diaphragm-type sensor and is interconnected to the throttling member through a lever pivoted at one end, this lever being subjected to the force of a compression spring that causes the lever to always be kept in contact with the sensor and the throttling member.

According to another aspect of this invention, the throttling member is a throttle valve.

DESCRIPTION OF THE PREFERRED EMBODIMENT

Figure 3:
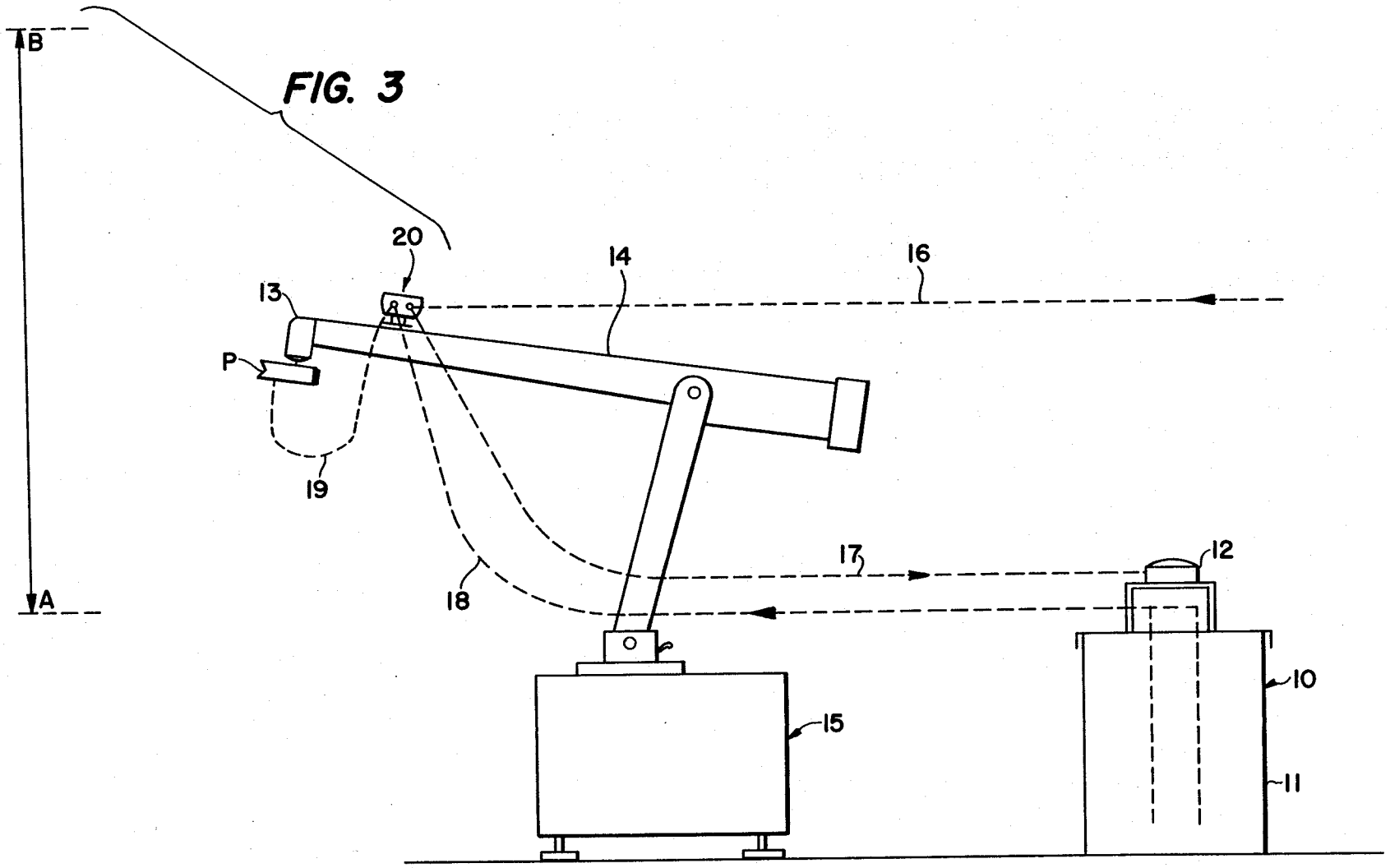
FIG. 3 is a schematic view of an enamelling or painting robot equipped with the device according to the invention, the various connections being also schematically shown.

Referring now to FIG. 3, the enamelling or painting plant outlined therein includes a feeder 10 comprising a tank 11 and a diaphragm air-operated pump 12 for supplying enamel to a spray gun P which in FIG. 3 is shown to be mounted on the wrist 13 of an arm 14 of a robot 15 intended to perform all of the various working movements that are required when treating the different articles to be enamelled or painted. Arranged on the robot arm 14, substantially the same at level as the spray gun P, is the pressure equalizer according to this invention, generally designated by the numeral 20.

Connected to this pressure equalizer are:

A line 16 for compressed air from a compressor;

A line 17 for compressed air from pump 12;

A feed line 18 for feeding enamel from feeder 10, and

A line 19 leading to the spray gun P.

Figure 1:
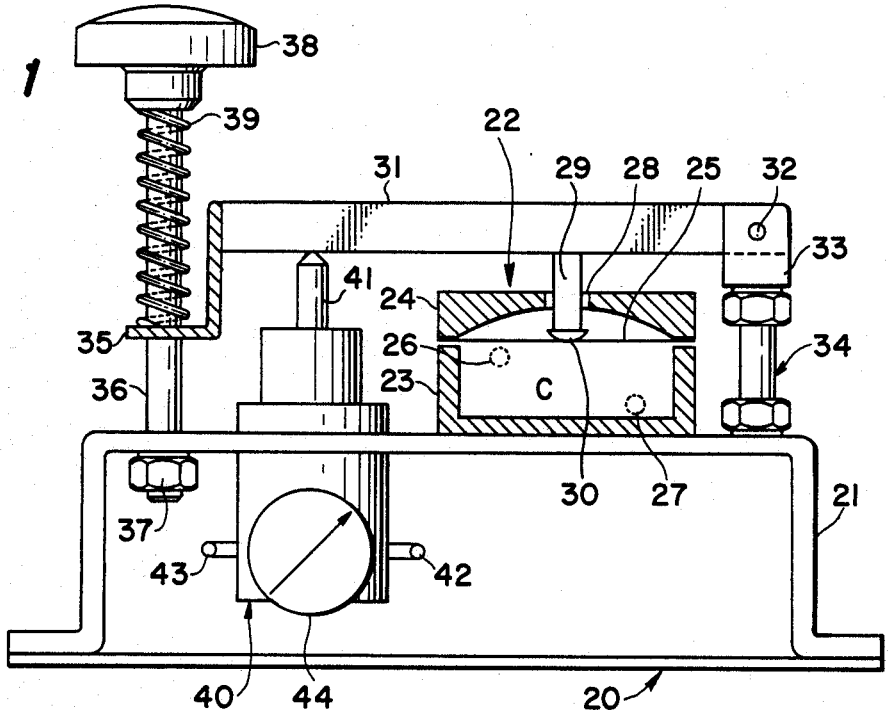
FIG. 1 is a longitudinal section view of an equalizer device according to the invention.
Figure 2:
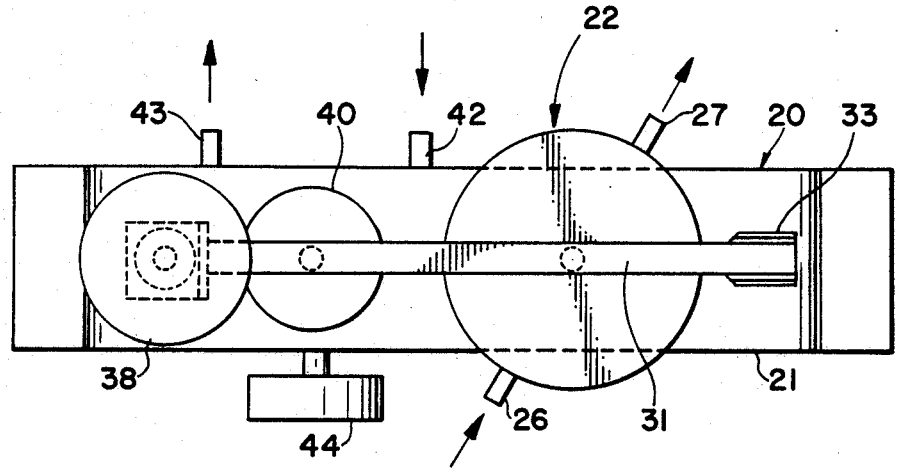
FIG. 2 is a plan view of the same device.
Figure 4:
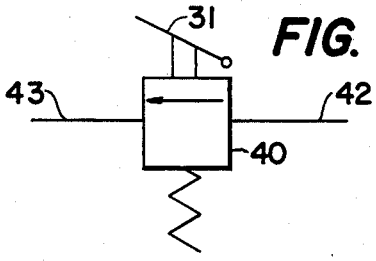
FIG. 4 is a schematic view of a value used in the present invention.

FIGS. 1 and 2 show the pressure equalizer in section and in plan , respectively. This pressure equalizer, which is designated by 20 includes a stirrup-shaped base 21 which has a pressure sensing element 22 mounted thereon. This pressure sensor 22 comprises a casing 23 and a cover 24 with a diaphragm 25 tightened therebetween such that a chamber C is formed beneath the diaphragm 25. The casing 23 is provided with an inlet fitting 26 and an outlet fitting 27 arranged in aligned relationship and designed to enable the pressure sensing element to be fitted to the lines 18 and 19 which are provided for admitting enamel material into the spray gun P. The cover 24 has a center hole 28 for receiving a pin 29 the lower end of which is provided with a head 30 designed to rest on the diaphragm 25. The pin 29 is connected at the top thereof to a lever 31 pivoted at 32 to a fork 33 which is secured to the base 21 through a bolt and nut connection generally indicated at 34. The lever 31 carries at its free end an L-shaped plate 35, the horizontal leg of which is provided with a hole (not shown) for receiving a bolt 36 which is fastened to the base of the pressure equalizer with the aid of a nut 37. At its other end, the bolt 36 has a knob 38 screwed thereon and acting as a stop for a counteracting compression spring 39 located between the L-shaped plate 35 and the knob 38. The counteracting spring 39 is effective for pushing the lever 31 downwardly to cause the pin 29 to be kept with its head 30 resting on the diaphragm 25. A value 40 is located intermediate the L-shaped plate 35 and the pressure sensor 22. Upwardly extending out of the valve 40 (shown schematically in FIG. 4) is a valve stem 41 which is kept resting against the lower surface of lever 31 by a spring .

The housing of the valve 40 has at the lower part thereof an inlet fitting 42 and an outlet fitting 43. The inlet fitting 42 is connected with the air pressure line 16 while the outlet fitting 43 is connected with the enamel pumping means 12. The valve 40 operates so that when the valve stem 41 is pressed downward, the valve element is moved in an opening direction. A pressure gauge 44 is connected to the valve 40 for indicating the pressure of the air going to the pump 12.

The pressure equalizer described above operates as follows: By operating the knob 38, the pressure equalizer 20 is initially calibrated so that the pump 12 of the feeder 10 will receive the correct pressure (e.g. 0.5 atm) suitable for feeding the enamel or paint material to the spray gun P when the latter is in a given position. When enamel is supplied by the pump to the spray gun P, the enamel first passes through the inlet fitting 26 into the chamber C and then via the outlet fitting 27 to the spray gun P so that the enamel applies calibration pressure to the diaphragm 25 which will also be applied to the lever 31 through the pin and head connection 29, 30.

When the spray gun P is moved upwardly during its performing of the enamelling or painting operation, a pressure reduction will occur in the pressure sensor 20 due to the higher elevation involved and thus the pump 12 is called to compensate for the elevated lead.

As a result, the lever 31 is caused to rotate counterclockwise under the force of the compression spring 39, whereby the valve stem 41 is pressed downward to move the valve element in a direction for opening the valve, the valve then allowing for more air to flow to the pump thereby increasing the pump delivery to compensate for the above mentioned reduction in pressure.

On the other hand, when the spray gun P is brought to a lower position, a pressure increase is experienced in the pressure sensor so that the diaphragm 25 is pushed in an upward direction. This will cause the lever 31, under action of the pin and head connection 29, 30, to rotate clockwise in opposition to the force of spring 39 and thus the valve stem 41 is moved upward under the action of its spring thereby moving the valve element in a direction to which closes the valve.

Therefore, a reduced flow of air will be admitted to the pump 12 to cause the pump to supply enamel to the spray gun at such a pressure as to compensate for the increased pressure generated in the pressure sensing element. This control action will automatically continue during the entire time that the spray gun is used for an enamelling or painting operation.

As a matter of fact, the described pressure equalizer is mounted on the spray gun in such a manner as to follow the latter in its working movements thereby enabling the pressure sensor 22 to sense the pressure exactly at the location at which the spray gun occupies at any precise time.

In FIG. 1, as already mentioned, the spray gun P is shown to be arranged on the wrist 13 of an arm 14 of a robot 15 which performs, according to a present-day usual practice, the enamelling or painting operation automatically in conformity with a preset program. Thus, the pressure equalizer 20 is mounted on arm 14 of the robot 15 in proximity to the spray gun P so that, in this case too, the pressure sensing element must follow the spray gun when it moves up and down vertically between the locations A and B (FIG. 3).

The robot system, as applied in the field of industrial painting, has successfully increased productivity, has improved the quality of the painted products and has saved enamel or paint material. The robot is in this case conceived with the purpose of imitating the complex human movements that are performed during the painting operations and it is controlled from a computer utilizing a number of microprocessors.

Generally, the robot is programmed through the so-called self-training or self-instructing mode, wherein the movements of a skilled operator are recorded onto a magnetic tape and then stored in the robot's memory.

The mounting of the pressure equalizer on the robot, in one case, or on the spray gun, in another case, enables the above mentioned substantial drawback, of the treated pieces being enamelled or painted in an uneven manner due precisely to the differences in elevation that the spray gun goes through during the movements thereof, to be obviated It should be apparent that the above described and illustrated embodiment of the invention related to a pressure equalizer utilizing mechanical means, has been given by way of an example only, and means, as for example pneumatic, hydraulic or electric means, could be used other than mechanical ones for applying the control signal from the pressure sensor to the valve controlling the pump, without departing from the scope of this invention, all of these alternative embodiments being intended to fall within the scope of the invention as defined in the appended claims.

What is claimed is:

1. A pressure equalizer for a paint or enameling system having an automatic spray gun for spraying paint or enamel, a paint feeder in which the paint or enamel is stored, a delivery line connected between the paint feeder and the spray gun, a supply line through which compressed air passes, an air operated pump operatively connected to the supply line and the feeder and operated by the compressed air for feeding the enamel or the paint from the feeder to the spray gun through said delivery line, and a vertically movable means to which the spray gun is mounted for moving the spray gun up and down to spray an article with the paint or the enamel, said pressure equalizer comprising:

a support means connected to the vertically movable means at substantially the same level as is the spray gun;

a pressure sensor mounted to said support means and operatively connected to the delivery line for detecting the pressure at which the paint or enamel passes therethrough when sprayed by the spray gun;

a valve means mounted to said support means and operatively connected to the supply line, said valve means movable in an opening direction to open the supply line and a closing direction to restrict the supply line;

a lever means having an end thereof pivotally connected to said support means and operatively connected at an adjustable predetermined position between said pressure sensor and said valve means, said lever means responsive to and pivoted from the predetermined position by said pressure sensor when the pressure sensor detects a relative increase or decrease in said pressure as the spray gun is moved up and down by the vertically movable means to spray the article, the lever means for moving said valve means in the opening and the closing directions, respectively, to regulate the flow of compressed air through the supply line as a function of the height of the spray gun and compensate for the effect of differences in atmospheric pressure on the flow of the paint or the enamel to the spray gun as the spray gun sprays the article; and a first spring means connected to and biasing the lever means to said predetermined position, the first spring means for adjustably fixing the lever means at said predetermined position thereby setting a reference rate at which the paint or the enamel flows through the delivery line to the spray gun.

2. A pressure equalizer as claimed in claim 1, wherein said pressure sensor comprises a chamber open to the delivery line and through which the paint or the enamel flows to the spray gun, a diaphragm covering the chamber and responsive to the pressure of the paint or the enamel therein, and a push-rod extending between said diaphragm and said lever means for transmitting movement of the diaphragm to the lever means.

3. A pressure equalizer as claimed in claim 1, wherein said valve means comprises a valve housing, a valve stem projecting from the housing and operatively connected to said lever means, and a spring means connected to the valve stem for biasing the valve stem in a direction opposite to the direction in which the first spring means biases said lever means.

4. A pressure equalizer as claimed in claim 1, and further comprising an adjustable knob adjustably mounted to said support means and to which said first spring means is operatively connected, the knob for adjusting the position of said first spring means relative to said lever means to move the lever means for adjusting said reference rate.

5. A pressure equalizer for a robotic painting or enameling system haivng an automatic spray gun for spraying paint or enamel, a paint feeder in which the paint or the enamel is stored, a delivery line connected between the paint feeder and the spray gun, a supply line through which compressed air passes, an air operated pump operatively connected to the supply line and the feeder and operated by the compressed air for feeding the enamel or the paint from the feeder to the spray gun, and a vertically movable robot arm havng a wrist to which the spray gun is mounted for moving the spray gun up and down to spray an article with the paint or the enamel, said pressure equalizer comprising:

a support means connected to the vertically movable means at substantially the same level as is the spray gun;

a pressure sensor mounted to said support means and operatively connected to the delivery line for detecting the pressure at which the paint or the enamel passes therethrough when sprayed by the spray gun;

a valve means mounted to said support means and operatively connected to the supply line, said valve means movable in an opening direction to open the supply line and a closing direction to restrict the supply line;

a lever means having an end thereof pivotally connected to said support means and operatively connected at an adjustable predetermined position between said pressure sensor and said valve means, said lever means responsive to and pivoted from the predetermined position by said pressure sensor when the pressure sensor detects a relative increase or decrease in said pressure as the spray gun is moved up and down by the vertically movable means to spray the article, the lever means for moving said valve means in the opening and the closing directions, respectively, to regulate the flow of compressed air through the supply line as a function of the height of the spray gun and compensate for the effect of differences in atmospheric pressure on the flow of the paint or the enamel to the spray gun as the spray gun sprays the article; and a first spring means connected to and biasing the lever means to said predetermined position, the first spring means for adjustably fixing the lever means at said predetermined position thereby setting a reference rate at which the paint or the enamel flows through the delivery line to the spray gun.

6. A pressure equalizer as claimed in claim 5, wherein said pressure sensor comprises a chamber open to the delivery line and through which the paint or the enamel flows to the spray gun, a diaphragm covering the chamber and responsive to the pressure of the paint or the enamel therein, and a push-rod extending between said diaphragm and said lever means for transmitting movement of the diaphragm to the lever means.

7. A pressure equalizer as claimed in claim 5, wherein said valve means comprises a valve housing, a valve stem projecting from the housing and operatively connected to said lever means, and a spring means connected to the valve stem for biasing the valve stem in a direction opposite to the direction in which the first spring means biases said lever means.

8. A pressure equalizer as claimed in claim 5, and further comprising an adjustable knob adjustably mounted to said support means and to which said first spring means is operatively connected, the knob for adjusting the position of said first spring means relative to said lever means to move the lever means for adjusting said reference rate.

9. A pressure equalizer for a paint or enameling system having an automatic spray gun for spraying paint or enamel, a paint feeder in which the paint or the enamel is stored, a delivery line connected between the paint feeder and the spray gun, a supply line through which compressed air passes, an air operated pump operatively connected to the supply line and the feeder and operated by the compressed air for feeding the enamel or the paint from the feeder to the spray gun through said delivery line, and a vertically movable means to which the spray gun is fixed for allowing the spray gun to be moved up and down to spray an article with the paint or the enamel, said pressure equalizer comprising:

a support means connected to the vertically movable means at substantially the same level as is the spray gun;

a pressure sensor mounted to said support means and operatively connected to the delivery line for detecting the pressure at which the paint or the enamel passes therethrough when sprayed by the spray gun;

a valve means mounted to said support means and operatively connected to the supply line, said valve means movable in an opening direction to open the supply line and a closing direction to restrict the supply line;

lever means connected to said support means and operatively connected at an adjustable predetermined position between said pressure sensor and said valve means, said lever means responsive to and moved by said pressure sensor when the pressure sensor detects a relative increase or decrease in said pressure as the spray gun is moved up and down by the vertically movable means to spray the article, the lever means for moving said valve means in the opening and the closing directions, respectively, to regulate the flow of compressed air through the supply line as a function of the height of the spray gun and compensate for the effect of differences in atmospheric pressure on the flow of the paint or the enamel to the spray gun as the spray gun sprays the article.

* * * * *